United States Patent [19]

Heaton et al.

[11] Patent Number: 4,649,397

[45] Date of Patent: Mar. 10, 1987

[54] THEFT DETERRENT TAG

[75] Inventors: Richard D. Heaton, Tipp City; Steven C. Linton, Waynesville, both of Ohio

[73] Assignee: Monarch Marking Systems, Inc., Dayton, Ohio

[21] Appl. No.: 721,095

[22] Filed: Apr. 8, 1985

[51] Int. Cl.[4] ..... H01Q 1/36; G08B 13/00

[52] U.S. Cl. ..... 343/895; 340/572; 24/160; 116/211

[58] Field of Search ..... 343/895; 340/571, 572; 116/211, 214; 24/160

[56] References Cited

U.S. PATENT DOCUMENTS

| | | | |
|---|---|---|---|
| 3,564,525 | 2/1971 | Robeson et al. | 340/571 |
| 3,942,829 | 3/1976 | Humble et al. | 292/316 |
| 4,187,509 | 2/1980 | Weiner | 343/895 |
| 4,483,049 | 11/1984 | Custavsson et al. | 24/160 |

*Primary Examiner*—Eli Lieberman

*Attorney, Agent, or Firm*—Joseph J. Grass

[57] ABSTRACT

There is disclosed a tag adapted to be attached to merchandise and the like to deter theft of the merchandise. The tag includes an electronically-detectable device and a frangible container to provide a telltale stain on the merchandise to show attempted unauthorized removal of the tag.

3 Claims, 3 Drawing Figures

FIG-1
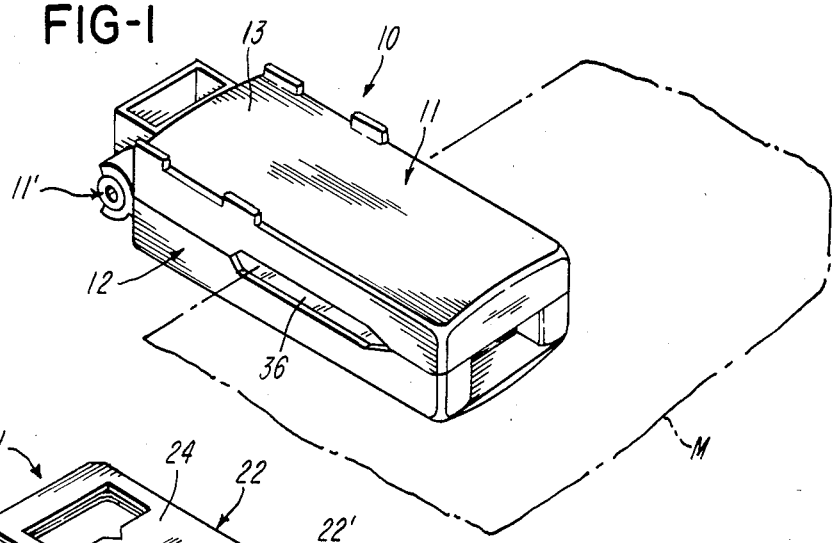
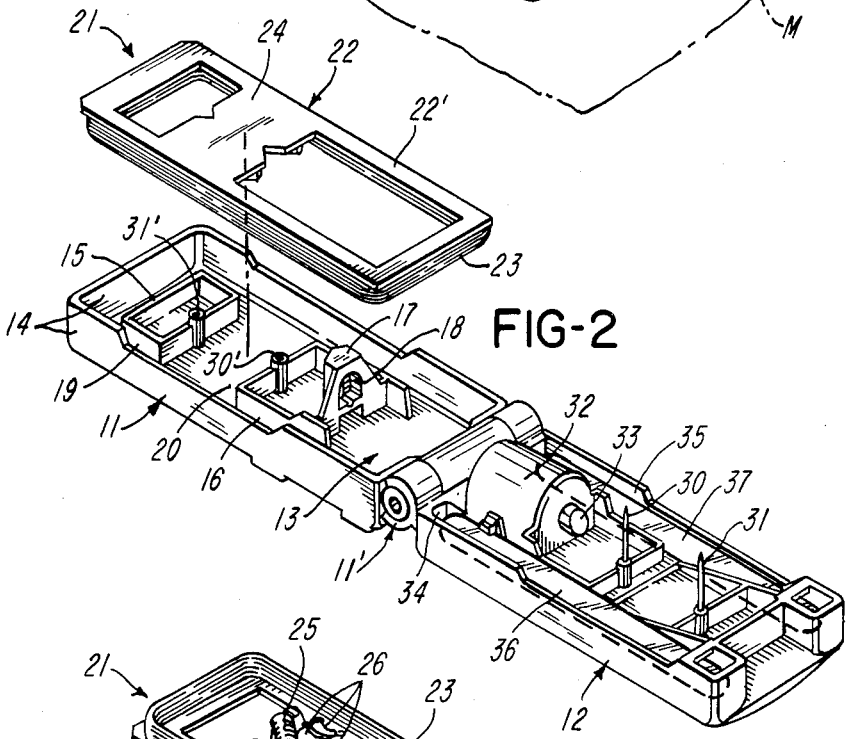
FIG-2
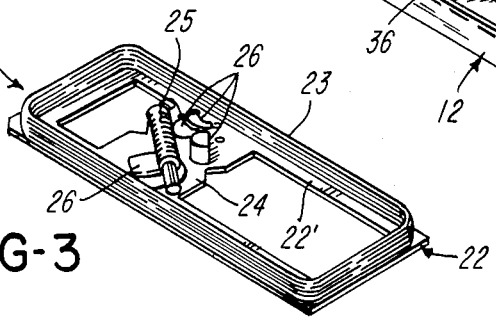
FIG-3

THEFT DETERRENT TAG

BACKGROUND OF THE INVENTION

1. Field of the Invention

This invention relates to the field of tags used to indicate the theft of merchandise.

2. Brief Description of the Prior Art

The following U.S. patents are made of record: 3,942,829; 4,481,428; and 4,483,049.

The theft-deterrent merchandise tag disclosed in U.S. Pat. No. 4,483,049 has been used in stores to provide a telltale indication of attempted removal of the tag. Would-be shoplifters frequently do not have the time or the tools to safely remove such tags while they are in the store. However, these tags provide no indication when the merchandise together with the tag is removed from the store. However, after the merchandise containing the tag has been removed from the store, the tag can be safely removed at the shoplifter's leisure.

Certain theft deterrent tags can be defeated as by body shielding and other types of shielding. Certain tags containing resonant radio circuits can be deactivated by scoring or cutting through one or more circuit elements.

SUMMARY OF THE INVENTION

This invention relates to a tag which can indicate electronically whether merchandise has been removed from a store or other area to be protected and also to indicate tampering with the tag per se. The tag contains a detectable device which can be, for example, a resonant circuit or a magnetically responsive element. The tag also houses a frangible container of a liquid dye which will spill onto the merchandise in the event a shoplifter attempts to forcibly remove the tag from the merchandise. The tag of the invention can only be readily opened by a special device in the possession of authorized store personnel.

In accordance with a specific embodiment of the invention, there is provided an electronically detectable tag adapted to be attached to an article of merchandise to be protected including a housing having a pair of housing members, with means for connecting the housing members to each other for movement between open and closed positions, and a releasable lock for securely locking the housing members to each other in the closed position attached to an article. The tag includes an electronically detectable device such as a resonant circuit or a magnetically responsive element. The device is mounted on one of the housing members. A frangible container for a liquid dye is housed in the other housing member. Attempted forcible opening of the housing as by a shoplifter results in the dye spilling onto the merchandise and/or the shoplifter. The illustrated device includes a resonant circuit with a wound coil and one or more electronic components mounted on a board. The coil and a portion of the board fit into a loop-shaped passage or channel in the one housing member. The board is in a figure-eight configuration and includes a bridge portion on which electronic components are mounted.

BRIEF DESCRIPTION OF THE DRAWINGS

FIG. 1 is a perspective view of a tag in accordance with the invention shown in a closed position locked to an article of merchandise;

FIG. 2 is a partially exploded perspective view of the tag in the open position; and FIG. 3 is a perspective view of the detectable device shown in FIG. 2.

DESCRIPTION OF THE PREFERRED EMBODIMENT

With reference to FIG. 1, there is shown a tag generally indicated at 10 having a pair of housing members 11 and 12 preferably pivotal at a hinge 11'. The tag 10 is shown locked to a portion of merchandise M. FIG. 2 shows the housing section 11 as having a shell-like contour with an end wall 13 and continuous generally rectangular side wall 14. Spaced inwardly from the wall 14 are generally rectangular members 15 and 16. The member 16 includes a locking member 17 having a recess 18. The space between the wall 14 and the members 15 and 16 defines a loop-type passage or channel 19 and the space between the members 15 and 16 defines a passage or channel 20 bridging spaced portions of the channel 19. A detectable device generally indicated at 21 includes a board for mounting member 22 having a rectangular portion 22' on which a wound coil 23 of rectangular shape is suitably mounted as by an adhesive. The board 22 also includes a bridge portion 24 on which electronic components such as a small helically wound coil 25 and various components 26 as disclosed in patent No. 4,481,428 are mounted. The coils 23 and 25 and the components 26 comprise a radio receiver-transmitter resonant circuit as in patent 4,481,428. The device 21 fits into the passages 19 and 20 and has a figure-eight configuration. The board 22 can be suitably held in the passages 19 and 20 as by adhesive.

The housing member 12 has a pair of sharp needles or pins 30 and 31 received in recesses 30' and 31' when the housing members 11 and 12 are in the closed position. The pins 30 and 31 pass readily through the merchandise M and hold the tag 10 thereto. The housing member 12 includes a lock 32 having a retractable pin 33 adapted to be received in the recess 18 to hold the housing members 11 and 12 locked together. The lock 32 is constructed as in U.S. Pat. No. 4,483,049 and is adapted to be pneumatically released.

The housing member 12 has a pair of spaced parallel channels 34 and 35 for snugly receiving frangible liquid-dye filled containers 36 and 37. The containers 36 and 37 will fracture when the housing member 12 is attempted to be opened relative to the housing member 11 without opening the lock 32 due to the fact that the housing member is constructed to flex and twist readily whereas the containers 36 and 37 are rigid and brittle and fracture readily. The tag 10 is readily electronically detectable by a receiver of a compatible article surveillance system. Any attempted unauthorized removal of the tag 10 in the store will cause one or both containers 36 and 37 to fracture so that the dye leaves a telltale dye spill on the merchandise M.

Other embodiments and modifications of the invention will suggest themselves to those skilled in the art, and all such of these as come within the spirit of this invention are included within its scope as best defined by the appended claims.

We claim:

1. A theft deterrent tag adapted to be attached to an article to be protected, comprising: a housing including a pair of housing members, means for connecting the housing members to each other for movement between open and closed positions, means for securely releasably locking the housing members to each other in the closed position attached to an article to be protected so that the housing members cannot be moved to the open position except upon using a special unlocking device, one of the housing members having means defining a continuous loop passage, a board disposed in the passage, a radio receiver-transmitter circuit including a coil, the coil being disposed on the board in the passage, a container for a liquid dye housed in the other housing member, and the container being readily frangible when the tag is attempted to be opening without releasing the locking means.

2. A theft deterrent tag as defined in claim 1, including another passage in the one housing member bridging spaced portions of the first-mentioned passage, the board having a bridge portion in the other passage, and an electrical component on the bridge portion.

3. A theft deterrent tag as defined in claim 1, wherein the board is generally in the shape of the figure eight.

* * * * *